US006481985B2

(12) United States Patent
Fujii et al.

(10) Patent No.: US 6,481,985 B2
(45) Date of Patent: Nov. 19, 2002

(54) MAXIMIZING THE LOAD TORQUE IN A SWASH PLATE COMPRESSOR

(75) Inventors: Toshiro Fujii, Kariya (JP); Kazuo Murakami, Kariya (JP); Yoshiyuki Nakane, Kariya (JP); Susumu Tarao, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/767,629

(22) Filed: Jan. 23, 2001

(65) Prior Publication Data

US 2001/0009644 A1 Jul. 26, 2001

(30) Foreign Application Priority Data

Jan. 25, 2000 (JP) ..... 2000-016077

(51) Int. Cl.[7] ..... F04B 17/00; F04B 1/12; F04B 1/00; F01B 3/00

(52) U.S. Cl. ..... 417/415; 417/269; 417/271; 92/71

(58) Field of Search ..... 417/269, 271, 417/415; 92/71

(56) References Cited

U.S. PATENT DOCUMENTS

| | | | | | |
|---|---|---|---|---|---|
| 2,465,638 | A | * | 3/1949 | Eckert | 123/197.1 |
| 3,672,793 | A | * | 6/1972 | Yowell | 417/203 |
| 3,901,093 | A | * | 8/1975 | Brille | 123/56.4 |
| 3,942,384 | A | * | 3/1976 | Parker | 417/269 |
| 4,030,404 | A | | 6/1977 | Meijer | 92/12.2 |
| 4,090,430 | A | * | 5/1978 | Matsumoto et al. | 417/269 |
| 4,095,921 | A | * | 6/1978 | Hiraga et al. | 417/269 |
| 5,207,078 | A | | 5/1993 | Kimura et al. | 62/509 |
| 5,694,784 | A | * | 12/1997 | Frey et al. | 62/228.5 |
| 5,741,124 | A | * | 4/1998 | Mazzucato et al. | 417/271 |
| 5,877,577 | A | * | 3/1999 | Ishizaki et al. | 310/261 |

FOREIGN PATENT DOCUMENTS

| | | | |
|---|---|---|---|
| DE | 42 29 069 A1 | 3/1993 | F04B/27/08 |
| DE | 196 16 962 A1 | 8/1997 | F04B/27/16 |
| DE | 197 33 147 C1 | 11/1998 | H02K/7/14 |
| JP | 5-187356 | 7/1993 | F04B/27/08 |

* cited by examiner

*Primary Examiner*—Edward K. Look
*Assistant Examiner*—Timothy P. Solak
(74) *Attorney, Agent, or Firm*—Morgan & Finnegan, LLP

(57) ABSTRACT

A motor-driven compressor performs suction, compression, and discharge of refrigerant. The compressor has four cylinder bores and four pistons. A swash plate is integrally rotated with a drive shaft. A transmission mechanism transmits rotation of the swash plate to the pistons. The ratio of the discharge pressure to the suction pressure when the discharge displacement of the compressor is maximum, that is, the compression ratio, is in a range of 2 to 4.5. The compressor is constructed to permit the size of the motor to be minimized.

6 Claims, 8 Drawing Sheets

10
11
12
13
14
15
16
17
18
19A
19C
20A
20C
21A
21C
22
23
24
25
26
27
28
29
30
31A
31C
32
33
34
35
36
43
121
131
132
133
134
135
141
142
143
161
241
242
251
261
301
R
Co
2
3
1b
9

| Curve | Compression ratio |
|---|---|
| r1 | 6 |
| r2 | 5 |
| r3 | 4.5 |
| r4 | 4 |
| r5 | 3.5 |
| r6 | 3 |
| r7 | 2.5 |
| r8 | 2 |

MAXIMIZING THE LOAD TORQUE IN A SWASH PLATE COMPRESSOR

BACKGROUND OF THE INVENTION

The present invention relates to a motor-driven compressor, which is provided with a drive shaft and a motor. Pistons are driven by a swash plate, which is integrally rotated with the rotating shaft, for discharging refrigerant.

An example of a compressor that is driven by an electric motor has been disclosed in Japanese Unexamined Patent Publication No. Hei 5-187356. In this compressor, piston supports are moved by rotation of a swash plate, and pistons are driven by rotation of the swash plate. A guide groove is formed on a drive plate, which is fixed to a drive shaft, and a pivot pin attached to the swash plate engages the guide groove. A sleeve is supported on the drive shaft. The swash plate is supported to permit inclination by the sleeve through a pin. The inclination of the swash plate is guided by engagement with the guide groove and the pivot pin, and by axial movement of the sleeve. The compression reactive force generated when the refrigerant is discharged from the cylinder bore is received by the drive plate through the piston, the piston support, a thrust bearing, the swash plate, and the pivot pin.

The compression reactive force transmitted to the drive plate through the swash plate acts as a load torque with respect to the drive shaft of the compressor. A plurality of pistons are arranged at equal intervals around the drive shaft. The load torque with respect to one piston peaks when discharging refrigerant and is substantially zero when drawing refrigerant.

In a motor-driven compressor, a peak of a net torque, which is obtained by combining changes in the load torques with respect to the respective pistons, is generated by one of the pistons during one rotation of the drive shaft. If a peak of the net torque is largely different from the average value of the net torque, it is necessary to use a motor that generates a driving torque that exceeds the peak value of the net torque. Such a motor must be relatively large, which means the entire motor-driven compressor is relatively large.

SUMMARY OF THE INVENTION

The object of the present invention is to miniaturize the motor-driven compressor.

To attain the above-mentioned object, a motor-driven compressor that performs suction, compression, and discharge of a refrigerant is provided. The compressor includes a housing, a drive shaft, a swash plate, a transmission mechanism and a motor. The housing includes four cylinder bores separated by equal angular intervals. The pistons are located in the cylinder bores, respectively. The drive shaft is rotatably supported by the housing. The swash plate is integrally rotated with the drive shaft. The transmission mechanism transmits the rotation of the swash plate to the pistons. The motor drives the drive shaft. The ratio of the discharge pressure to the suction pressure when the discharge displacement of the compressor is maximum, that is, the compression ratio, is in a range of 2 to 4.5.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 1(*b*) is a cross-sectional view taken along the line 1*b*—1*b* of FIG. 1(*a*);

FIG. 5(*b*) is a graph showing the net torque of a compressor that has three pistons;

FIG. 5(*c*) is a graph showing the net torque of a compressor that has four pistons;

FIG. 6(*b*) is a graph showing the net torque of a compressor that has six pistons;

FIG. 6(*c*) is a graph showing the net torque of a compressor that has eight pistons;

FIG. 11(*b*) is a diagrammatic view of a motor corresponding to FIG. 10;

DETAILED DESCRIPTION OF THE PREFERRED EMBODIMENTS

A first embodiment of the present invention will be described below with reference to FIGS. 1 to 8.

Figure 1:
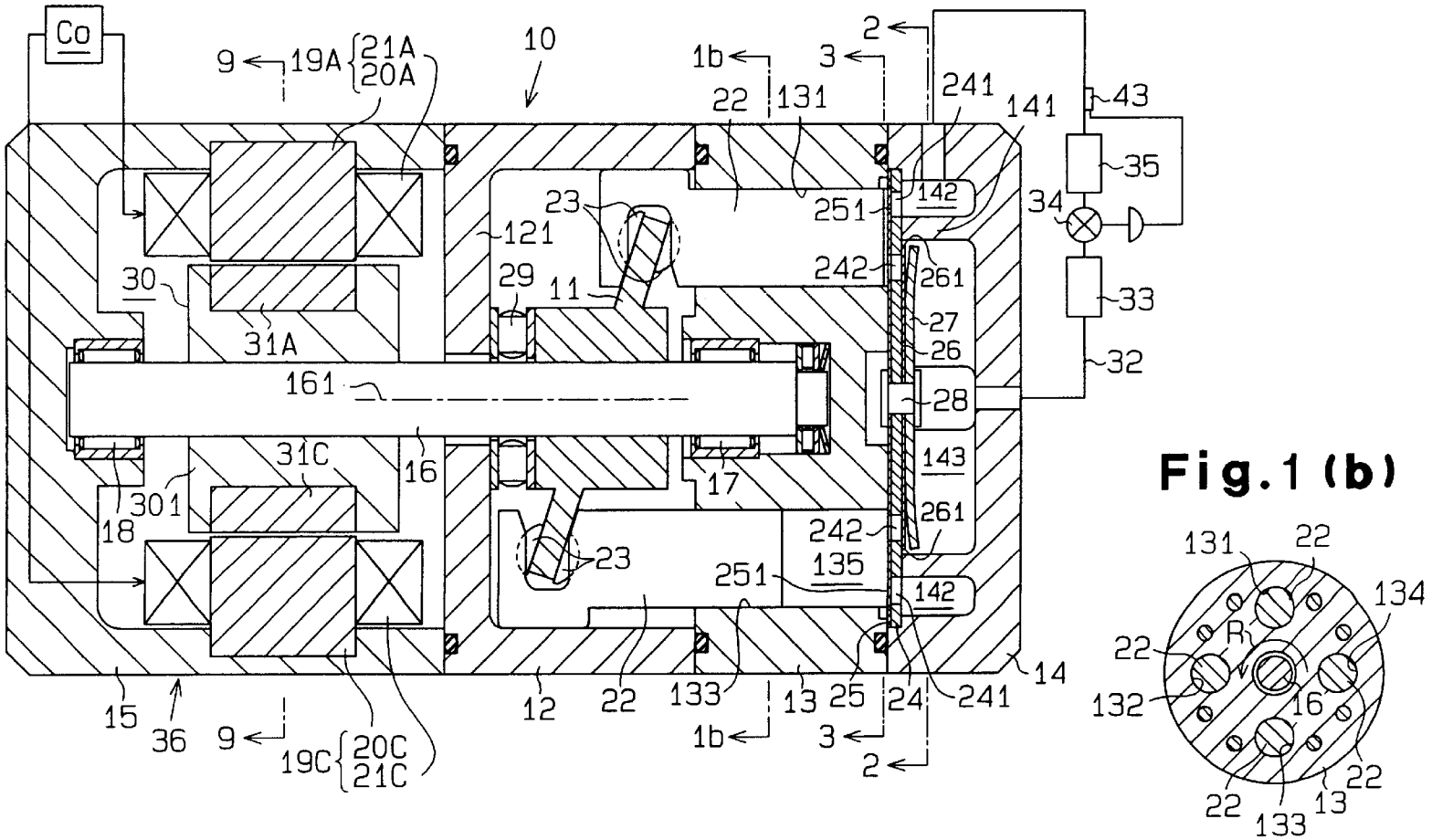
FIG. 1(*a*) shows a first embodiment of the present invention, and illustrates a cross-sectional side view of motor-driven compressor.

As shown in FIG. 1(*a*), a cylinder block 13 and a motor housing 15 are connected to a swash plate housing 12, which contains a swash plate 11. To the cylinder block 13 is connected a front housing 14. A drive shaft 16 is rotatably supported on the motor housing 15 and the cylinder block 13 through radial bearings 17 and 18. The swash plate 11 is attached to the drive shaft 16 within the swash plate housing 12.

A plurality of stators 19A and 19C (only two stators are shown in FIG. 1(*a*)) are mounted on the inner circumferential surface of the motor housing 15, and a rotor 30 is attached to the drive shaft 16 within the motor housing 15. The respective stators 19A and 19C include iron cores 20A and 20C, and coils 21A and 21C are wound around the iron cores 20A and 20C, respectively. The rotor 30 includes a support cylinder 301 attached to the drive shaft 16 and a plurality of magnets 31A and 31C (only two magnets are shown in FIG. 1(*a*)) attached to the circumferential surface of the support cylinder 301. Energization of the stators 19A and 19C is controlled by an energization control device Co. The rotor 30 is rotated by energization of the coils 21A and 21C, and the drive shaft 16 and the swash plate 11 are integrally rotated together with the rotor 30. The drive shaft 16 is rotated in the direction of an arrow R shown in FIG. 1(*b*). The stators 19A and 19C and the rotor 30 form a motor 36.

Figure 3:
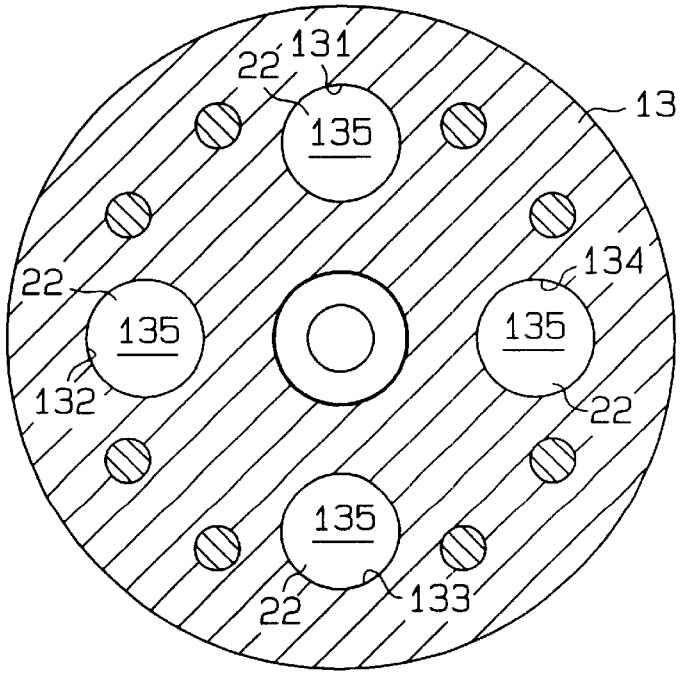
FIG. 3 is a cross-sectional view taken along the line 3—3 of FIG. 1(*a*)

As shown in FIG. 1(*b*) and FIG. 3, there are four cylinder bores 131, 132, 133, and 134 in the cylinder block 13. The four cylinder bores 131–134 are arranged on a circle at equal angular intervals about the axis 161 of the drive shaft 16. A single head piston 22 is housed in each of the bores 131 to 134. Each single head piston 22 defines a compressing chamber 135 within the respective bores 131, 132, 133, and 134.

As shown in FIG. 1(*a*), a pair of shoes 23 is located between the swash plate 11 and each single head piston 22. The rotational force of the swash plate 11 is transmitted to the piston 22 through the shoes 23, and the pistons 22 are reciprocated within the respective cylinder bores 131–134 by the rotation of the swash plate 11.

Figure 2:
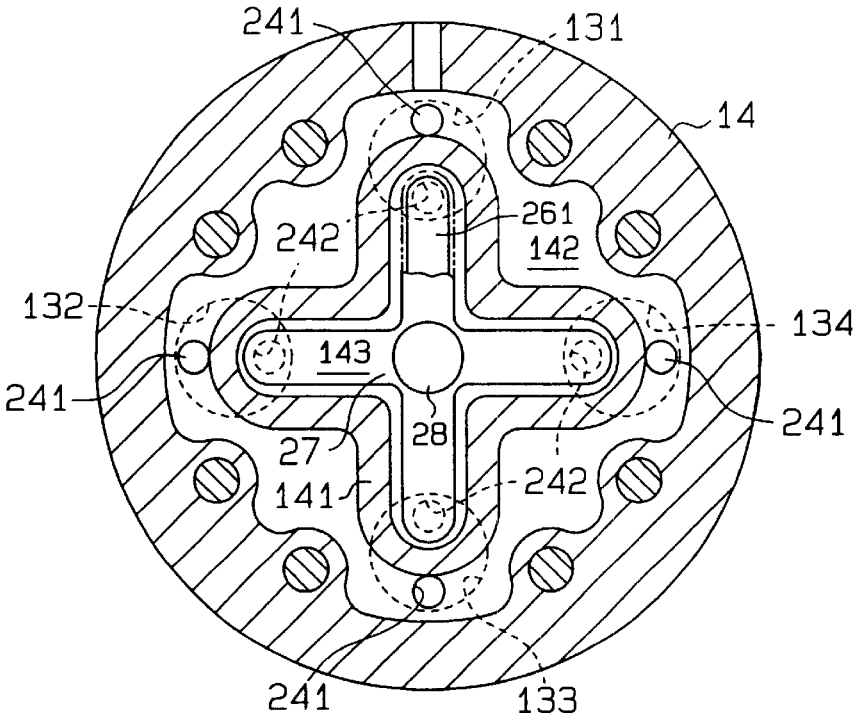
FIG. 2 is a cross-sectional view taken along the line 2—2 of FIG. 1(*a*)

First and second valve plates 24 and 25 are located between the front housing 14 and the cylinder block 13. As shown in FIG. 2, the front housing 14 is partitioned into a suction chamber 142 and a discharge chamber 143 by a partitioning wall 141.

As shown in FIG. 1(*a*), a third valve plate 26 and a retainer 27 are clamped and secured to the first valve plate 24 within the discharge chamber 143 by a rivet 28. Suction ports 241 are formed in the first valve plate 24 between the suction chamber 142 and the respective cylinder bores 131, 132, 133, and 134. Further, discharge ports 242 are formed in the first valve plate 24 and the second valve plate 25 between the discharge chamber 143 and the respective cylinder bores 131, 132, 133, and 134. Suction valves 251 are formed in the second valve plate 25, and discharge valves 261 are formed in the third valve plate 26. The suction valves 251 open and close the suction ports 241, respectively, and the discharge valves 261 open and close the discharge ports 242, respectively.

Refrigerant within the suction chamber 142 causes a corresponding suction valve 251 to flex toward the corresponding compressing chamber 135 during an intake stroke of the corresponding piston 22. During a discharge stroke of one of the pistons 22, the corresponding discharge valve 261 is opened, and refrigerant is discharged to the discharge chamber 143. Each discharge valve 261 contacts the retainer 27 to limit the extent of its motion. The suction chamber 142 and the discharge chamber 143 are connected by the external refrigerant circuit 32. The refrigerant that flows into the external refrigerant circuit 32 from the discharge chamber 143 is circulated to the suction chamber 142 via a condenser 33, an expansion valve 34, and an evaporator 35 of the external refrigerant circuit 32.

Figure 4:
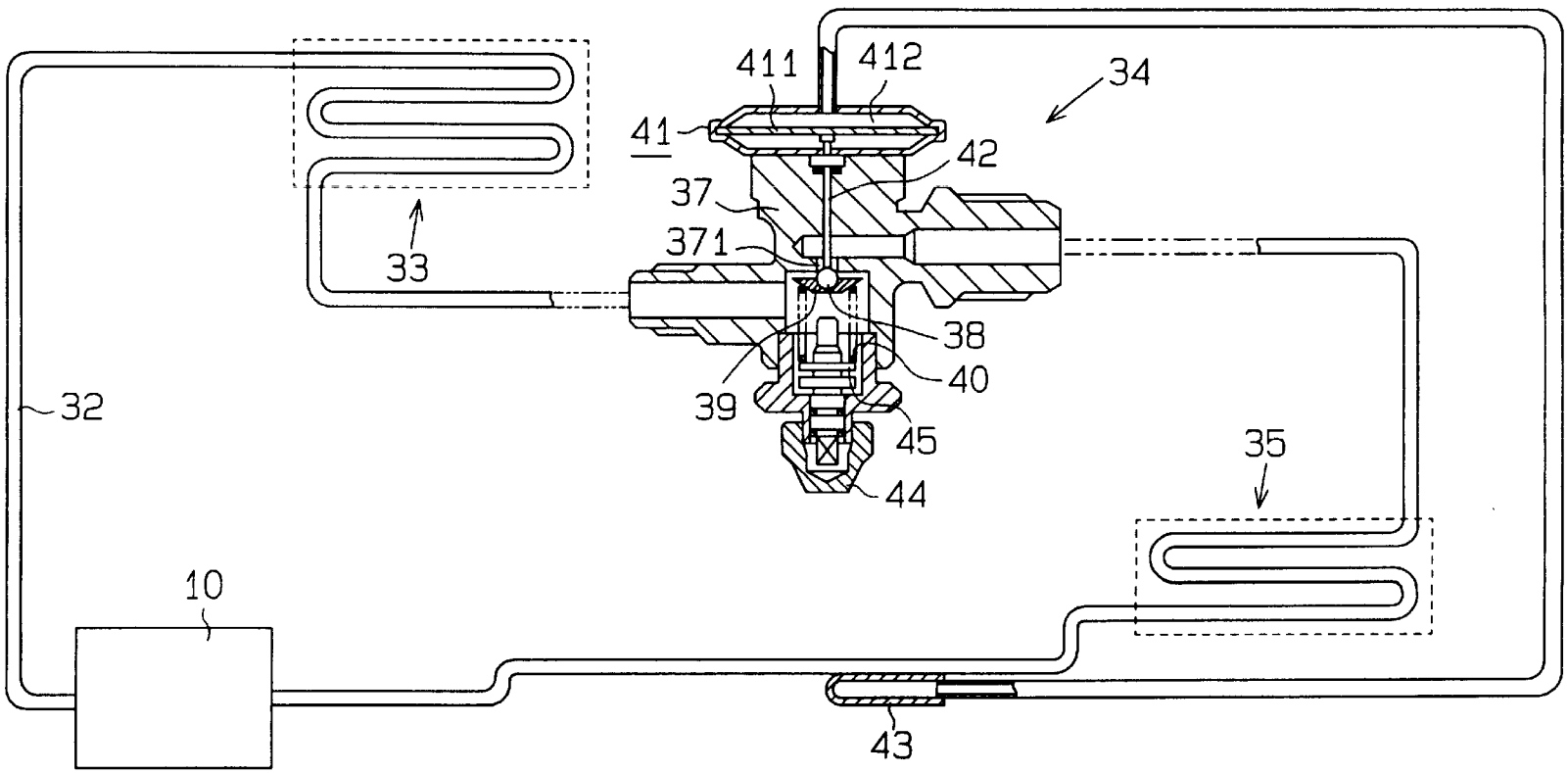
FIG. 4 is a diagram of a refrigerant circuit.

In the present embodiment, carbon dioxide is used as the refrigerant. FIG. 4 shows the internal structure of the expansion valve 34. An orifice 371 formed in the valve housing 37 of the expansion valve 34 is opened and closed by a ball valve 38, and the ball valve 38 is urged by the spring force of a spring 40 through a support seat 39 in a direction to close the orifice 371. A diaphragm 41 is mounted on the top portion of the valve housing 37. A controlled pressure chamber 412 is partitioned by a partitioning film 411 within the diaphragm 41, and a transmission rod 42 is connected to the partitioning film 411. The transmission rod 42 is moved in the vertical direction, that is, upward or downward in FIG. 4, in accordance with the pressure variation within the controlled pressure chamber 412, so that the ball valve 38 opens the orifice 371 or permits the orifice 371 to be closed, depending on the force applied to the rod 42 by the film 411.

A temperature sensing cylinder 43 is mounted on a refrigerant tube path between the evaporator 35 and the motor-driven compressor 10, and gas pressure within the temperature sensing cylinder 43 is applied to the controlled pressure chamber 412. When the gas pressure within the temperature sensing cylinder 43 increases, the partitioning film 411 is moved downward in FIG. 4, so that the opening size in the orifice 371 increases. That is, when the ambient temperature of the evaporator 35 increases and the cooling load increases, the gas pressure within the temperature sensing cylinder 43 increases, and the flow rate of liquid refrigerant in the expansion valve 34 increases. On the contrary, when the gas pressure within the temperature sensing cylinder 43 decreases, the partitioning film 411 is moved upward in FIG. 4, and the opening seize in the orifice 371 decreases. That is, when the ambient temperature of the evaporator 35 decreases and the cooling load decreases, the gas pressure within the temperature sensing cylinder 43 decreases, and the flow rate of the liquid refrigerant in the expansion valve 34 decreases.

The opening size of the orifice 371 can be changed by adjusting the spring force of the spring 40. An adjustment control or knob 44 is threaded to the valve housing 37, and when knob 44 is rotated, the position of the spring receiver 45 is changed. The spring force of the spring 40 is changed by the change of the position of the spring receiver 45, so that the opening size of the orifice 371 can be changed. When the spring force of the spring 40 increases, the opening size of the orifice 371 decreases, and the suction pressure Ps decreases. On the other hand, when the spring force of the spring 40 decreases, the opening size of the orifice 371 increases, and the suction pressure Ps increases. Therefore, the ratio of the discharge pressure Pd to the suction pressure Ps (Pd/Ps) can be adjusted by the knob 44.

As shown in FIG. 1(*a*), a thrust bearing 29 is located between the swash plate 11 and the end wall 121 of the swash plate housing 12. The compression reaction force generated when refrigerant is discharged from the compressing chamber 135 to the discharge chamber 143 by the reciprocation of the pistons 22 is received by the end wall 121 through the piston 22, the shoes 23, the swash plate 11 and the thrust bearing 29.

When the drive shaft 16 is at the angle of rotation shown in FIGS. 1(*a*) and 1(*b*) (the angle of rotation in this state is defined as 0°) , the piston 22 within the upper cylinder bore 131 is at the top dead center position, and the opposite piston 22, which is in the lower bore 133, is at the bottom dead center position. Furthermore, the piston 22 within the left cylinder bore 132 (See FIG. 1(*b*)) is in the middle of the discharge stroke and is moving from the bottom dead center position to the top dead center position. The piston 22 within the right cylinder bore 134 (as viewed in FIG. 1(*b*)) is in the middle of the intake stroke and is moving from the top dead center position to the bottom dead center position.

Figure 5A:
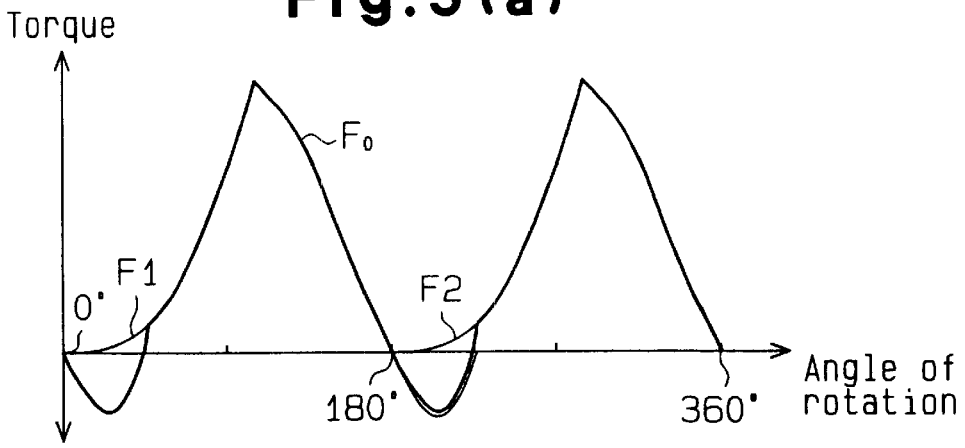
FIG. 5(*a*) is a graph showing the net torque of a compressor that has two pistons.
Figure 5B:
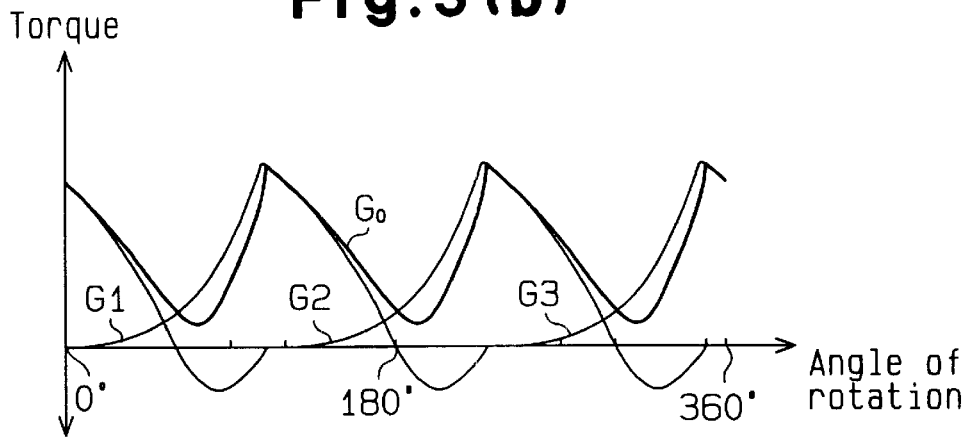
Figure 5C:
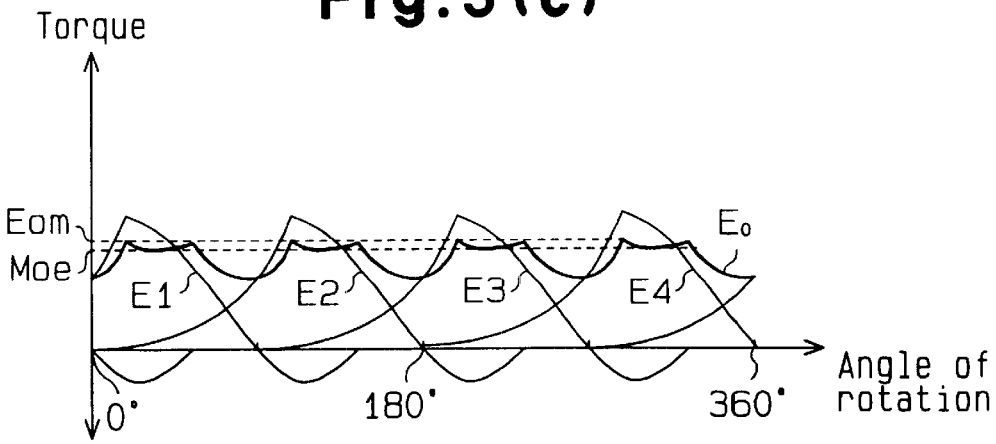

Curves E1, E2, E3, and E4 shown in FIG. 5(*c*) indicate changes in the load torques of the drive shaft 16 in correspondence with the compression reactive forces from the compression chambers 135 in the respective cylinder bores 131, 132, 133, and 134. The curve Eo indicates the combined torque, or net torque, which is obtained by combining the load torques shown by the curves E1, E2, E3, and E4. The horizontal axis indicates the angle of rotation of the drive shaft 16. The combined torque Eo regularly changes every time the drive shaft 16 is rotated by 90°.

Curves F1 and F2 in FIG. 5(*a*) indicate changes in the load torques of the drive shaft 16 corresponding to the compression reactive forces from the compression chambers of the respective cylinder bores for the compressor in which two pistons 22 are arranged at equal angular intervals about the axis 161 of the drive shaft 16. The curve Fo indicates the net torque, which is obtained by combining the load torques shown by the curves F1 and F2. The net torque Fo regularly changes every time the drive shaft 16 is rotated by 180°.

Curves G1, G2 and G3 in FIG. 5(*b*) indicate changes of the load torques of the drive shaft 16 corresponding to the compression reactive forces from the compression chambers of the respective cylinder bores for a compressor like that of FIG. 1(*a*) that has three pistons 22 arranged at equal angular intervals about the axis 161 of the drive shaft 16. The curve Go indicates the net torque, which is obtained by combining the load torques shown by the curves G1, G2 and G3. The net torque Go regularly changes every time the drive shaft 16 is rotated by 120°.

Figure 6A:
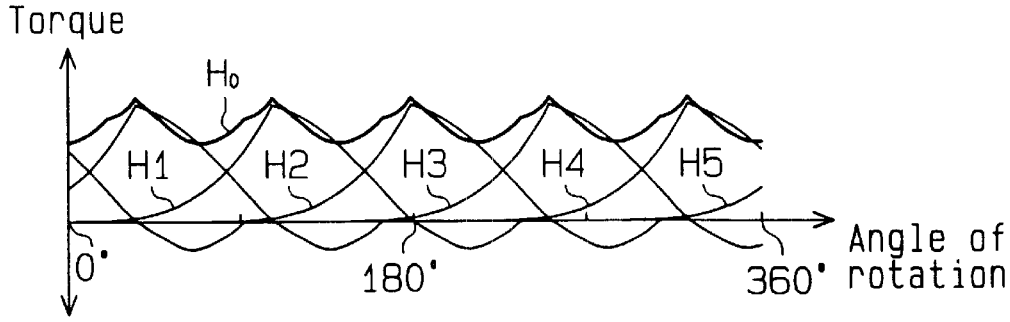
FIG. 6(*a*) is a graph showing the net torque of a compressor that has five pistons.
Figure 6B:
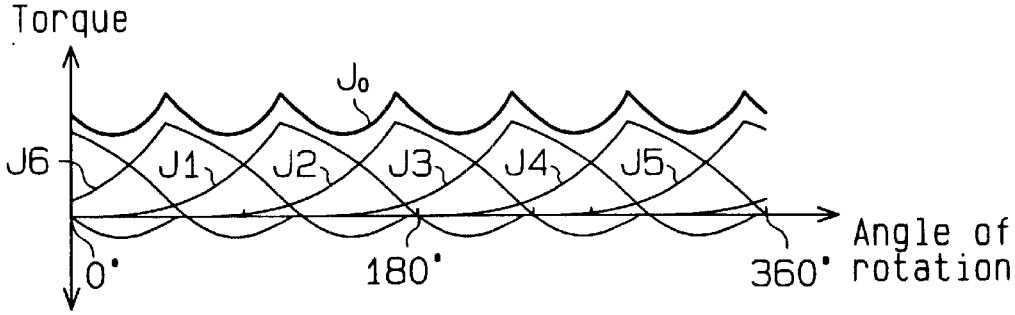
Figure 6C:
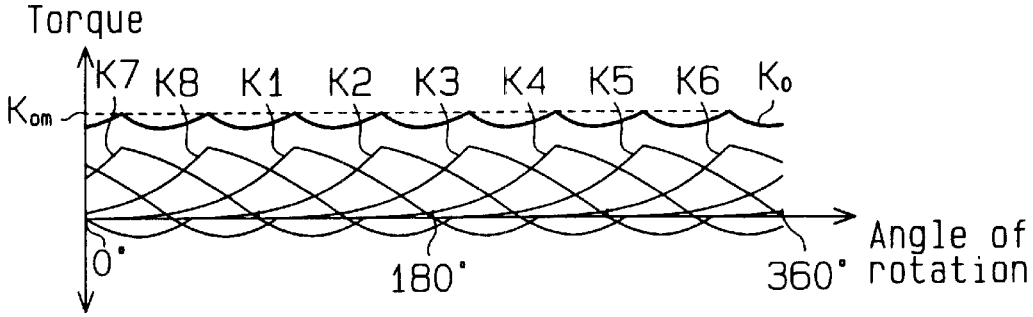

Curves H1, H2, H3, H4, and H5 in FIG. 6(*a*) indicate changes in the load torques of the drive shaft 16 corresponding to the compression reactive forces from the compression chambers of the respective cylinder bores in a compressor like that of FIG. 1(*a*) that has five pistons arranged at equal angular intervals about the axis 161 of the drive shaft 16. The curve Ho indicates the net torque, which is obtained by combining the load torques shown by the curves H1, H2, H3, H4, and H5. The net torque Ho regularly changes every time the drive shaft 16 is rotated by 72°.

Curves J1, J2, J3, J4, J5 and J6 in FIG. 6(*b*) indicate changes in the load torques of the drive shaft 16 corresponding to the compression reactive forces from the compression chambers of the respective cylinder bores for a compressor like that of FIG. 1(*a*) that has six pistons arranged at equal angular intervals about the axis 161 of the drive shaft 16. The curve Jo indicates the net torque, which is obtained by combining the load torques shown by the curves J1, J2, J3, J4, J5 and J6. The net torque Jo regularly changes every time the drive shaft 16 is rotated by 60°.

Curves K1, K2, K3, K4, K5 K6, K7, and K8 in FIG. 6(*c*) indicate changes in the load torques of the drive shaft 16 corresponding to the compression reactive forces from the compression chambers of the respective cylinder bores for a compressor like that of FIG. 1(*a*) that has eight pistons arranged at equal angular intervals about the axis 161 of the drive shaft 16. The curve Ko indicates the net torque, which is obtained by combining the load torques shown by the curves K1, K2, K3, K4, K5 K6, K7, and K8. The net torque Ko regularly changes every time the drive shaft 16 is rotated by 45°.

The graphs of FIGS. 5(*a*), 5(*b*), and 5(*c*) and FIGS. 6(*a*), 6(*b*), and 6(*c*) are obtained under the conditions that the discharge displacements for one rotation of the drive shaft 16 are the same, and that the refrigerant compression ratio of Pd/Ps=3. Setting the compression ratio Pd/Ps is performed by the operation of the knob 44 of the expansion valve 34.

Figure 7:
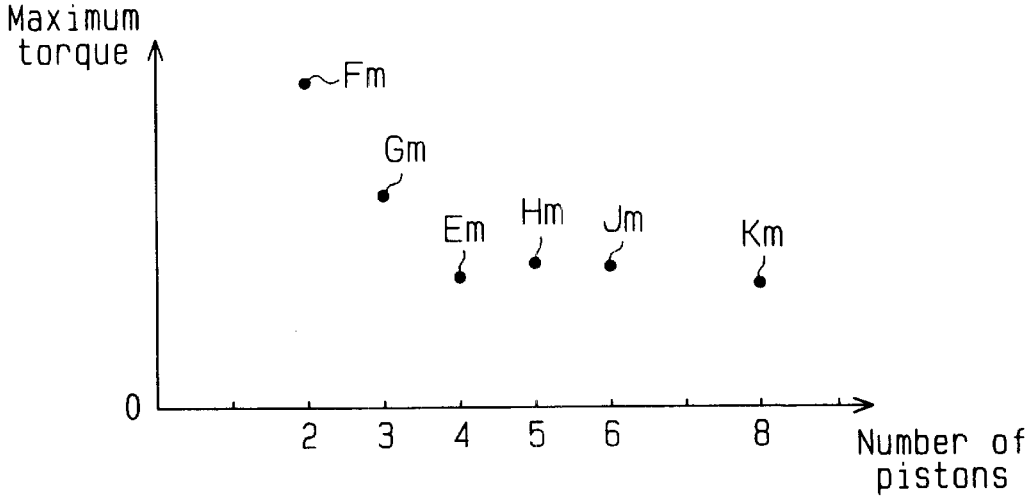
FIG. 7 is a graph showing maximums of the net torques corresponding to the numbers of pistons.

The graph of FIG. 7 shows the maximum values of the net torques for each compressor, or for each number of pistons 22. The horizontal axis in the graph of FIG. 7 indicates the number of the pistons 22. The point Fm indicates the maximum value of the net torque for the compressor having two pistons. The point Gm indicates the maximum value of the net torque in the compressor having three pistons. The point Em indicates the maximum value of the net torque in the compressor having four pistons. The point Hm indicates the maximum value of the net torque in the compressor having five pistons. The point Jm indicates the maximum value of the net torque in the compressor having six pistons. The point Km indicates the maximum value of the net torque in the compressor having eight pistons.

Figure 8:
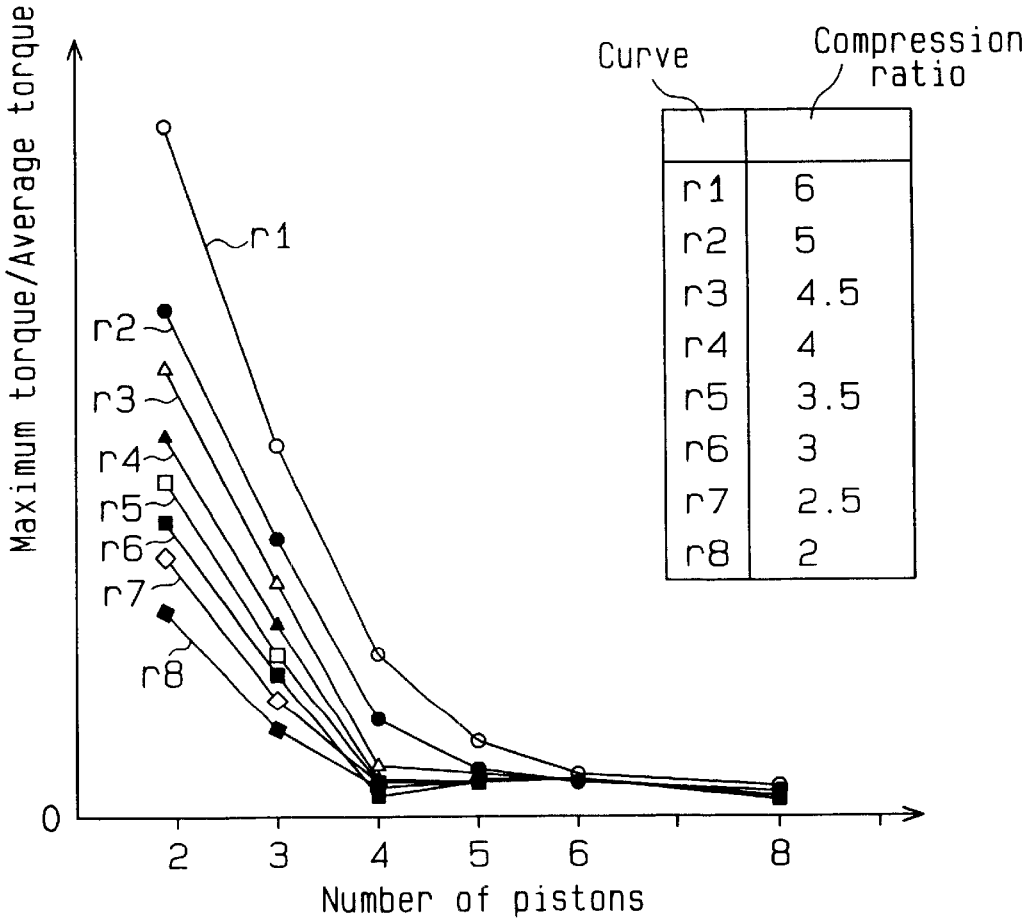
FIG. 8 is a graph showing the ratio of maximum net torque to average net torque for various compression ratios in relation to the number of pistons.

The graph of FIG. 8 indicates changes in the ratio (Max/Mo) of the maximum value Max of the net torque to the average value Mo for various compression ratios Pd/Ps in relation to the number of pistons. The empty circles (○) on the curve r1 represent Max/Mo when the compression ratio Pd/Ps is six, and the solid circles (●) on the curve r2 represent Max/Mo when the compression ratio is five. The empty triangles (Δ) on the curve r3 represent Max/Mo when the compression ratio Pd/Ps is four and one half. The solid triangles (▲) on the curve r4 represent Max/Mo when the compression ratio Pd/Ps is four. The empty squares (□) on the curve r5 represent Max/Mo when the compression ratio Pd/Ps is three and one half. The solid squares (□) on the curve r6 represent Max/Mo when the compression ratio Pd/Ps is three. The empty diamonds (◇) on the curve r7 represent Max/Mo when the compression ratio Pd/Ps is two and one half. The solid diamonds (◆) on the curve r8 represent Max/Mo when the compression ratio Pd/Ps is two. The horizontal axis in FIG. 8 indicates the number of pistons. The average value Mo=Moe of the net torque in the compressor having four pistons 22 is shown in FIG. 5(*c*).

As shown by the graph of FIG. 7, when the number of the pistons 22 is four or more, the maximum values Mmax of the net torques Fo, Go, Eo, Ho, Jo, and Ko decreases. The smaller the maximum value Max of net torque, the smaller the required torque. If the required torque is smaller, a smaller motor may be used.

If the number of the pistons 22 is four or eight, the maximum value Eom (shown in FIG. 5(*c*)) and the maximum value Kom (shown in FIG. 6(*c*)) are smaller than the corresponding maximum net torques of compressors having five or six pistons. The larger the number of the pistons 22, the larger the body size of the compressor. Accordingly, the compressor having eight pistons 22 does not serve the goal of miniaturization. Therefore, a compressor having four pistons 22 is the most preferred on view of miniaturization.

The ratio Max/Mo of the maximum net torque to the average thereof shown by the graph of FIG. 8 reflects the degree of variation of the net torques, and the smaller the ratio Max/Mo, the smaller the required output (driving torque) of the motor 36. Regardless of the compression ratio Pd/Ps, as the number of the pistons is increased, the ratio Max/Mo generally decreases. However, when the compression ratio Pd/Ps is 4.5 or less (curve r3 and the following curves), when the number of the pistons is increased above the four ratios Max/Mo remain substantially the same. When the compression ratio Pd/Ps exceeds 4.5, the ratio Max/Mo generally decreases as the number of the pistons is increased.

Therefore, in a compressor in which the compression ratio Pd/Ps exceeds 4.5 and the number of the pistons 22 is four, the output (driving torque) of the motor 36 cannot be significantly decreased. On the other hand, in a compressor in which the compression ratio Pd/Ps is 4.5 or less and the number of the pistons 22 is four, the motor 36 can be a relatively low torque motor.

However, when the compression ratio Pd/Ps is below 2, it is disadvantageous in setting temperature of the evaporator 35 at 0° C. or more or in causing the temperature to be near 0° C. as soon as possible. When the temperature of the evaporator 35 is set at 0° C. or lower, frost is generated on the surface of the evaporator 35, and the heat transfer effect is reduced. Accordingly, it is desirable that the compression ratio Pd/Ps be two or more.

Therefore, in a motor-driven compressor, it is preferred to employ four pistons and to choose the refrigerant such that the compression ratio is in a range of 2 to 4.5, for the goal of miniaturization.

When the compression ratio Pd/Ps is 2.5 or more and 4 or less, the ratio Max/Mo is minimum when the number of the pistons 22 is four. Accordingly, in a motor-driven compressor, it is preferred to user four pistons and to choose the refrigerant such that the compression ratio is in a range of 2 to 4.5, for the goal of miniaturization.

Carbon dioxide, which is a refrigerant that is used at very high pressures as compared with Freon, is preferred when used at a compression ratio of 2 to 4.5.

The discharge displacement is constant in a compressor in which the angle of inclination of the swash plate 11 is constant with respect to the drive shaft 16. Thus, the discharge pressure Pd becomes substantially constant, and the compression ratio Pd/Ps is substantially constant. Therefore, the output of the motor 36 is efficiently used, and a compressor having a fixed discharge displacement is optimum for application of the present invention.

Next, a second embodiment of the present invention shown in FIGS. 9 to 13 will be described.

Figure 9:
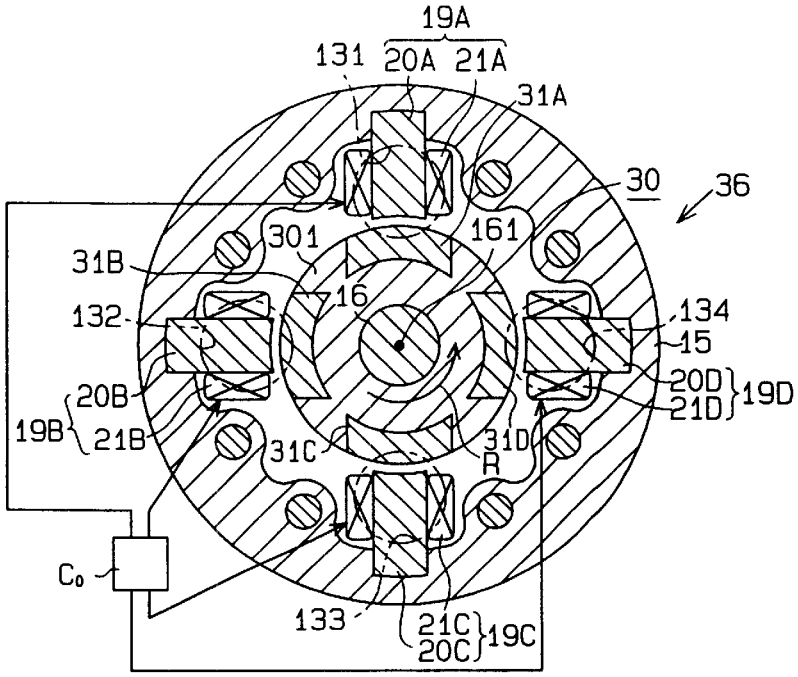
FIG. 9 is a cross-sectional view taken along the line 9—9 of FIG. 1, showing a second embodiment of the present invention.

FIG. 9 is a cross-sectional view taken along the line 9—9 of FIG. 1. As shown in FIG. 9, a plurality of stators 19A, 19B, 19C, and 19D (four stators in this embodiment) are attached to the inner circumferential surface of the motor housing 15, and a rotor 30 is attached to the drive shaft 16 in the motor housing 15. The respective stators 19A, 19B, 19C, and 19D include iron cores 20A, 20B, 20C, and 20D, and coils 21A, 21B, 21C, and 21D, which are wound around the iron cores 20A, 20B, 20C, and 20D, respectively.

The rotor 30 includes a support cylinder 301, which is attached to the drive shaft 16, and a plurality of magnets 31A, 31B, 31C, and 31D, which are attached to the circumferential surface of the support cylinder 301. The number of the magnets 31A, 31B, 31C, and 31D is the same as that of the iron cores 20A, 20B, 20C, and 20D. The iron cores 20A, 20B, 20C, and 20D are arranged at equal angular intervals (90°) about the drive shaft 16. Also, the magnets 31A, 31B, 31C, and 31D are arranged at equal angular intervals (90°) about the drive shaft 16.

The N poles of two of the magnets 31A and 31C are located on the peripheral surface of the support cylinder 301, and the S poles of the other two magnets 31B and 31D are located on the peripheral surface of the support cylinder 301. The rotor 30 is rotated by energization of the coils 21A, 21B, 21C, and 21D, which form stators 19A, 19B, 19C, and 19D, respectively, and the drive shaft 16 and the swash plate 11 are rotated integrally with the rotor 30. The stators 19A, 19B, 19C, and 19D, and the rotor 30 form a motor 36.

The angle of rotation of the drive shaft 16 of FIG. 9 corresponds to that of FIG. 1. That is, when the drive shaft 16 is at the position shown in FIG. 9 (the angle of rotation in this state is defined as 0°), the piston 22 within the upper cylinder bore 131 (as viewed in FIG. 1(*a*)) is at the top dead center position, and the lower piston 22 within the opposite cylinder bore 133 is at the bottom dead center position. Furthermore, the piston 22 within the left cylinder bore 132 (See FIG. 1(*b*)) is in the middle of the discharge stroke and is moving from the bottom dead center position to the top dead center position, and the piston 22 within the right cylinder bore 134 is in the middle of the suction stroke and is moving from the top dead center position to the bottom dead center position.

Figure 10:
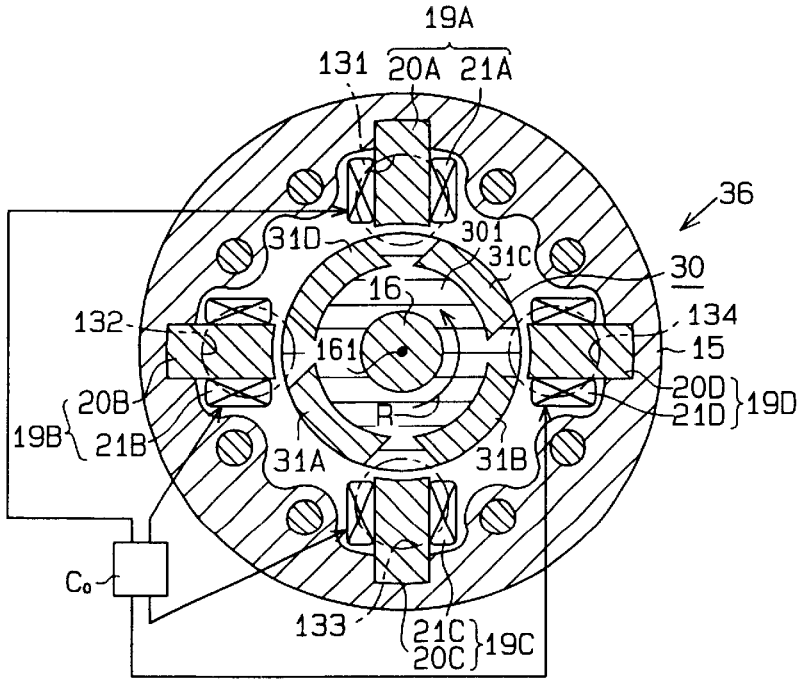
FIG. 10 is a cross-sectional view showing the state where a rotor is rotated by a predetermined angle from the state of FIG. 9.

In the state of FIG. 9, the iron core 20A faces the magnet 31A, the iron core 20B faces the magnet 31B, the iron core 20C faces the magnet 31C, and the iron core 20D faces the magnet 31D. FIG. 10 show a state in which the drive shaft 16 is rotated by 135° from the state of FIG. 9 in the direction of the arrow R.

Figure 11:
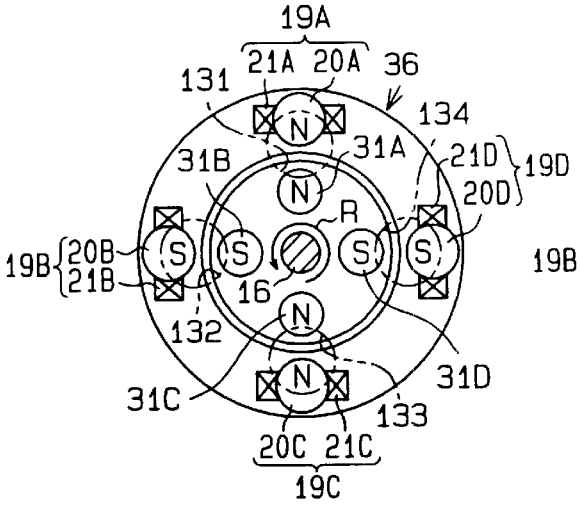
FIG. 11(*a*) is a diagrammatic view of a motor corresponding to FIG. 9.
Figure 11:
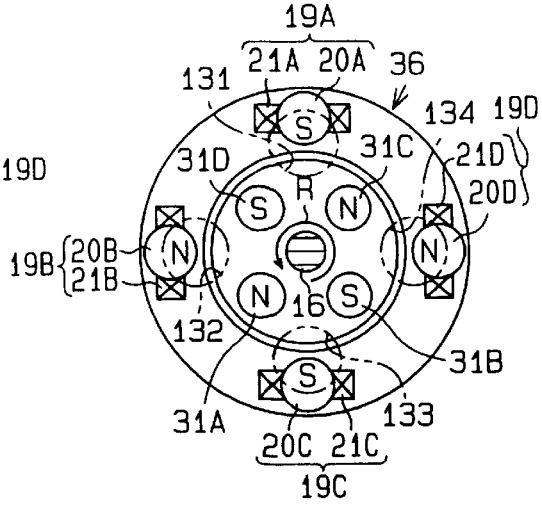

FIG. 11(*a*) is a diagrammatic view of FIG. 9, and FIG. 11(*b*) is a diagrammatic view of FIG. 10. The letter N in FIG. 11(*a*) indicates the N poles, which are located on the circumferential surface of the support cylinder 301 in one opposed pair of the magnets 31A and 31C. Also, the S poles in FIG. 11(*a*) indicates the S poles, which are located on the circumferential surface of the support cylinder 301 in the other opposed pair of the magnets 31B and 31D.

Figure 12:
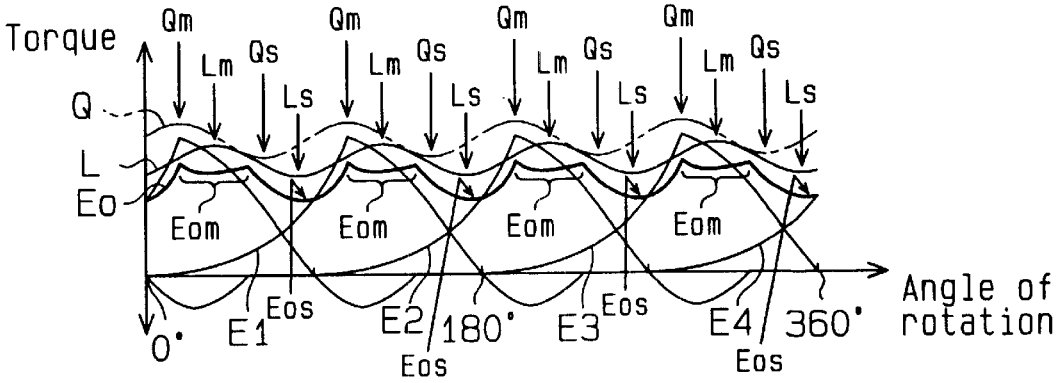
FIG. 12 is a graph showing a combined torque and a driving torque.
Figure 13:
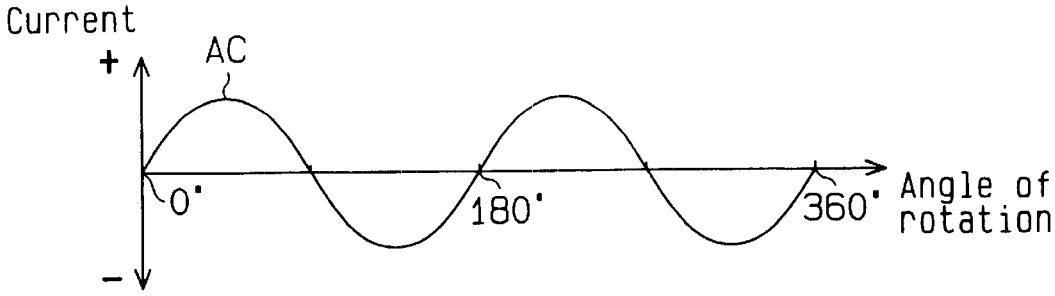
FIG. 13 is a graph showing the current of a stator coil.

Curves E1, E2, E3, and E4 shown in FIG. 12 indicate changes in the load torques of the drive shaft 16 corresponding to the compression reactive forces from the compression chambers 135 in the respective cylinder bores 131, 132, 133, and 134. The curve Eo indicates the net torque, which is obtained by combining the load torques represented by the curves E1, E2, E3, and E4. The horizontal axis indicates the angle of rotation of the drive shaft 16. The net torque Eo regularly changes every time the drive shaft 16 is rotated by 90°.

The net torque Eo has the minimum value Eos in the vicinity of the angles of rotation of 0°, 90°, 180°, and 270°, at which the iron cores 20A, 20B, 20C, and 20D substantially face the magnets 31A, 31B, 31C, and 31D, respectively, as shown in FIGS. 9 and 11(*a*). Further, the net torque Eo has the maximum values Eom in the vicinity of the angles of rotation of 45°, 135°, 225°, and 315°, at which the iron cores 20A, 20B, 20C, and 20D are angularly spaced from the magnets 31A, 31B, 31C, and 31D by about 45°, respectively, as shown in FIGS. 10 and 11(*b*).

As shown in FIGS. 1, 9, and 10, the respective coils 21A, 21B, 21C, and 21D, of the stators 19A, 19B, 19C, and 19D are controlled by the energization control device Co. The energization control device Co supplies alternate current AC shown in FIG. 13 to the coils 21A, 21B, 21C, and 21D. The horizontal axis represents the angle of rotation of the drive shaft 16. In the state of FIG. 11(*a*) in which the angle of rotation is 0°, the N poles are generated at opposite sides of the support cylinder 301 in the iron cores 20A and 20C by the supply of alternate current AC, and the S poles are generated at opposite sides of the support cylinder 301 in the iron cores 20B and 20D by the supply of alternate current AC.

In the state of FIG. 11(*b*) in which the angle of rotation is 135°, the S poles are generated at opposite sides of the support cylinder 301 in the iron cores 20A and 20C by the supply of alternate current AC, and the N poles are generated at the opposite sides of the support cylinder 301 in the iron cores 20B and 20D by the supply of alternate current AC.

The curve L in FIG. 12 shows the driving torque of the motor 36, which is generated by the supply of alternate current AC to the coils 21A, 21B, 21C, and 21D. The driving torque L regularly changes every time the drive shaft is rotated by 90°. The driving torque L has minimum values Ls where the iron cores 20A, 20B, 20C, and 20D substantially face the magnets 31A, 31B, 31C, and 31D, respectively, as shown in FIGS. 9 and 11(*a*). Further, the driving torque L has maximum values Lm where the iron cores 20A, 20B, 20C, and 20D are angularly spaced from the magnets 31A, 31B, 31C, and 31D, by about 45°, respectively, as shown in FIGS. 10 and 11(*b*).

In the compressor of the second embodiment, which has four cylinder bores, 131, 132, 133, and 134, the graph of the net torque Eo has four minimum locations Eos and four maximum locations Eom. The graph of the driving torque L generated in the motor 36 by the energization control device Co has four minimum locations Ls and four maximum locations Lm. The timing of the minimum locations Eos of the net torque Eo corresponds to the timing of the minimum locations Ls of the driving torque L, and the timing of the maximum locations Eom of the net torque Eo also corresponds to the timing of the maximum locations Lm of the driving torque L. Further, the driving torque L of the motor 36 always exceeds the net torque Eo.

Otherwise, the compressor is the same as that of the first embodiment.

The second embodiment has the following advantages:

A curve Q in FIG. 12 indicates the torque of a prior art compressor. The timing of the minimum values Eos of the combined torque Eo is out of phase with the minimum values Qs of the driving torque Q. Accordingly, the timing of the maximum range Eom of the combined torque Eo is also out of phase with the maximum values Qm of the driving torque Q.

However, a compressor in which the minimum values Eos of the combined torque Eo and the minimum values Ls of the driving torque L are in phase and, at the same time, the maximum values Eom of the combined torque Eo and the maximum values Lm of the driving torque L are in phase enables the use of a smaller motor 36 that does not produce excess torque. Such a motor 36 is smaller than a motor that always provides excess torque Q. Therefore, the entire compressor is more compact.

In a piston type compressor in which a plurality of pistons 22 are arranged around the axis 161 of the drive shaft 16 reciprocated based on the rotation of the drive shaft 16, the minimum value Eos and the maximum range Eom of the combined torque Eo are generated by the pistons 22 during every single rotation of the drive shaft 16. In the present embodiment, the number of the pistons 22 is four, and the number of the poles of the motor 36 is also four. This configuration enables the minimum values Ls of the driving torque L of the motor 36 to be in phase with all of the minimum values Eos of the combined torque Eo, and it enables the maximum ranges Lm of the driving torque L of the motor 36 to be in phase with all of the maximum values Eom of the combined torque Eo. This permits a relatively small motor 36 that does not produce excess torque to be used, which permits miniaturization of the compressor.

The present invention can be applied to the following embodiments.

(1) Not all but some of the minimum values of the combined torque that occur during one rotation of the drive shaft may be in phase with the minimum values of the driving torque of the motor;

(2) Not all but some of the maximum range of the combined torque generated during one rotation of the drive shaft may be in phase with the maximum values of the driving torque of the motor;

(3) The motor of the motor-driven compressor may have two poles;

(4) The motor of the motor-driven compressor may have a number of poles that is an integer multiple of the number of the pistons (4) may be used; and (5) The present invention can be applied to a variable displacement compressor in which the angle of inclination of swash plate can be changed.

It should be apparent to those skilled in the art that the present invention may be embodied in many other specific forms without departing from the spirit or scope of the invention. Particularly, it should be understood that the invention may be embodied in the following forms.

Therefore, the present examples and embodiments are to be considered as illustrative and not restrictive and the invention is not to be limited to the details given herein, but may be modified within the scope and equivalence of the appended claims.

What is claimed is:

1. A motor-driven compressor that performs suction, compression, and discharge of a refrigerant comprising:

a housing, wherein the housing includes four cylinder bores separated by equal angular intervals;

pistons located in the cylinder bores, respectively;

a drive shaft rotatably support by the housing;

a swash plate, which is integrally rotated with the drive shaft;

a transmission mechanism, which transmits the rotation of the swash plate to the pistons; and a motor, which drives the drive shaft, the motor including:

stators, the number of which is the same as that of the cylinder bores, the respective stators being located at angular positions that match the angular positions of the respective cylinder bores;

a rotor that is integrally rotated with the drive shaft; and magnets, the number of which is the same as that of the stators, the magnets being arranged at predetermined angular intervals about the periphery of the rotor, wherein the ratio of the discharge pressure to the suction pressure, when the discharge displacement of the compressor is maximum, is in a range of 2 to 4.5.

2. The motor-driven compressor according to claim 1, wherein the refrigerant is carbon dioxide.

3. The motor-driven compressor according to claim 1, wherein a net torque, which is a combination of load torques transmitted from the respective pistons to the drive shaft, has at least one minimum value during one revolution of the drive shaft, and the timing of the minimum net torque value is substantially in phase with the timing of a minimum value of the driving torque of the motor.

4. The motor-driven compressor according to claim 1, wherein a net torque, which is a combination of load torques transmitted from the respective pistons to the drive shaft, has at least one maximum range during one revolution of the drive shaft, and the timing of the maximum range is substantially in phase with the timing of a maximum value of the driving torque of the motor.

5. The motor-driven compressor according to claim 4, wherein the driving torque of the motor always exceeds the net torque.

6. The motor-driven compressor according to claim 1, wherein the angle of inclination of the swash plate with respect to the drive shaft is fixed.

* * * * *